US008434463B2

(12) United States Patent
Bednar et al.

(10) Patent No.: US 8,434,463 B2
(45) **Date of Patent: *May 7, 2013**

(54) MULTI-POSITION DRAW WEIGHT CROSSBOW

(75) Inventors: Richard L. Bednar, Munroe Falls, OH (US); Michael J. Shaffer, Mogadore, OH (US)

(73) Assignee: Hunters Manufacturing Company, Inc., Suffield, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/197,208

(22) Filed: Aug. 3, 2011

(65) Prior Publication Data

US 2011/0283983 A1 Nov. 24, 2011

Related U.S. Application Data

(63) Continuation of application No. 12/511,129, filed on Jul. 29, 2009, now Pat. No. 8,033,275, and a continuation of application No. 11/539,000, filed on Oct. 5, 2006, now Pat. No. 7,624,724.

(60) Provisional application No. 60/723,893, filed on Oct. 5, 2005.

(51) Int. Cl.
*F41B 5/12* (2006.01)

(52) U.S. Cl.
USPC ..... 124/25

(58) Field of Classification Search ..... 124/25
See application file for complete search history.

(56) References Cited

U.S. PATENT DOCUMENTS

| | | | | |
|---|---|---|---|---|
| 214,791 | A | 4/1879 | Randall | |
| 1,375,990 | A * | 4/1921 | Yorgensen | 124/25 |
| 3,277,878 | A | 10/1966 | Pankratz | |
| 4,545,358 | A | 10/1985 | Collins | |
| 4,593,675 | A | 6/1986 | Waiser | |
| 4,603,676 | A | 8/1986 | Luoma | |
| 4,649,891 | A * | 3/1987 | Bozek | 124/25 |
| 4,716,880 | A * | 1/1988 | Adkins | 124/25 |
| 4,732,134 | A | 3/1988 | Waiser | |
| 4,766,874 | A | 8/1988 | Nishioka | |
| 4,786,874 | A * | 11/1988 | Grosso et al. | 340/853.4 |
| 4,827,894 | A | 5/1989 | Schallberger | |
| 4,989,577 | A | 2/1991 | Bixby | |
| 5,025,771 | A | 6/1991 | Hanson | |
| 5,115,795 | A | 5/1992 | Farris | |

(Continued)

FOREIGN PATENT DOCUMENTS

| | | |
|---|---|---|
| EP | 0041206 | 5/1981 |
| EP | 0132017 | 8/1984 |
| WO | 91/04453 | 4/1991 |
| WO | 01/94870 | 12/2001 |

*Primary Examiner* — John Ricci
(74) *Attorney, Agent, or Firm* — Brouse M^c Dowell; Michael G. Craig

(57) ABSTRACT

A crossbow may include a main beam: (a) a bow assembly including a bow and a bow string adapted to propel an arrow; (b) a trigger mechanism mounted to the main beam; (c) and a bow assembly mounting apparatus for use in selectively mounting the bow assembly at a first location on the main beam to provide a first draw weight and for use in selectively mounting the bow assembly to a second location on the main beam to provide a second draw weight that is substantially different from the first draw weight.

3 Claims, 10 Drawing Sheets

U.S. PATENT DOCUMENTS

| | | | | | |
|---|---|---|---|---|---|
| 5,220,906 | A | | 6/1993 | Choma | |
| 5,437,260 | A | | 8/1995 | King | |
| 5,445,139 | A | * | 8/1995 | Bybee | 124/23.1 |
| 5,553,596 | A | * | 9/1996 | Bednar | 124/25 |
| 5,649,521 | A | | 7/1997 | King | |
| 5,749,348 | A | * | 5/1998 | Oviedo-Reyes | 124/25 |
| 5,823,172 | A | * | 10/1998 | Suggitt | 124/25 |
| 6,095,128 | A | * | 8/2000 | Bednar | 124/25 |
| 6,286,496 | B1 | | 9/2001 | Bednar | |
| 6,571,785 | B1 | | 6/2003 | Choma | |
| 6,799,566 | B1 | | 10/2004 | Maluccelli | |
| 6,913,007 | B2 | * | 7/2005 | Bednar | 124/25 |
| 8,033,275 | B2 | * | 10/2011 | Bednar et al. | 124/25 |

* cited by examiner

MULTI-POSITION DRAW WEIGHT CROSSBOW

This continuation patent application claims priority to U.S. Ser. No. 12/511,129 titled Multi-Position Draw Weight Crossbow, filed Jul. 29, 2009, which is a continuation of U.S. Pat. No. 7,624,724, titled Multi-Position Draw Weight Crossbow, filed Oct. 5, 2006, which is incorporated herein by reference, which claims priority to provisional patent application, U.S. Ser. No. 60/723,893, titled Method and Apparatus for Multi-Position Draw Weight Crossbow, filed Oct. 5, 2005, which provisional application is incorporated herein by reference.

I. BACKGROUND OF THE INVENTION

A. Field of Invention

This invention relates generally to the field of crossbows and, more specifically, to apparatuses and methods regarding changing the draw weight of a crossbow.

B. Description of the Related Art

Crossbows have been used for many years as a weapon for hunting, fishing, and for target shooting. In general, a crossbow includes a main beam including a stock member and a barrel connected to the stock member. The barrel typically has an arrow receiving area for receiving the arrow that is to be shot. The crossbow also includes a bow assembly supported on the main beam that includes a bow and a bowstring connected to the bow for use in shooting arrows. A trigger mechanism, also supported on the main beam, holds the bowstring in a drawn or cocked condition and can thereafter be operated to release the bowstring out of the drawn condition to shoot the arrow.

One way to rate crossbows is by their draw weight, which is the amount of force require to draw or pull the bowstring into the cocked condition. The draw weight of a crossbow is a major factor in determining the speed at which the arrow will be fired. As a general rule, the greater the draw weight, the faster the arrow will travel. Known crossbow draw weights vary considerably, from 50 pounds (LBS) to 200 LBS, for example. This produces an equally varying range of initial arrow speeds, from 130 feet per second (FPS) to 350 FPS, for example.

While known crossbows having distinct draw weights generally work well for their intended purpose, they have an important disadvantage. This disadvantage is based on the fact that the desired draw weight for a particular use may vary. Hunters, for example, may desire a relatively larger draw weight to provide a flatter trajectory and thus improved firing accuracy.

The particular atmospheric conditions may also require varying crossbow draw weights. Hunting or target practice in fog, rain, snow or strong winds, for example, may require faster arrow speeds. When the atmospheric conditions are relatively mild, however, hunting or target practice may be accomplished using a slower arrow speed.

The desired draw weight for a crossbow may also vary based on the user. It may be desirable, for example, to start a young and/or inexperienced user with a smaller draw weight crossbow and then, as the user gains in experience and skill, provide a larger draw weight. Some other user characteristics that may variably affect the desired crossbow draw weight include advancing age, health, injury, flexibility, eyesight, disability, and the like.

The conventional solution to this need for varying crossbow draw weights is to provide multiple crossbows—each having a distinct and specific draw weight. The use of multiple crossbows, however, has the disadvantage of increased expense to purchase multiple crossbows. The use of multiple crossbows also has the disadvantage of inconvenience because the user must now transport the numerous crossbows to the point of use and switch between them, as needed.

The crossbow of this invention can be easily adjusted to provide multiple draw weights. In this way the disadvantages known in the art can be overcome in a way that is better, more efficient and that provides better overall results.

II. SUMMARY OF THE INVENTION

According to one embodiment of this invention, a crossbow includes a main beam; a bow assembly including a bow and a bow string adapted to propel an arrow; a trigger mechanism mounted to the main beam; and a bow assembly mounting apparatus for use in selectively mounting the bow assembly at a first location on the main beam to provide a first draw weight and for use in selectively mounting the bow assembly to a second location on the main beam to provide a second draw weight that is substantially different from the first draw weight.

According to another embodiment of this invention, a bow includes a block and a pair of limbs extending from the block. The block is selectively mountable at first and second locations on the main beam.

According to another embodiment of this invention, the main beam has first and second portions separated by a groove. A portion of the bow assembly moves within the groove as the bow assembly is moved between first and second locations on the main beam.

According to still another embodiment of this invention, a method includes the steps of: (A) providing a crossbow that has a main beam, a bow assembly adapted to propel an arrow and a trigger mechanism; (B) mounting the bow assembly at a first location on the main beam to provide a first draw weight; (C) moving the bow assembly from the first location to a second location on the main beam; and (D) mounting the bow assembly to the second location on the main beam to provide a second draw weight that is substantially different from the first draw weight.

According to another embodiment of this invention, the main beam has at least two predetermined locations where the bow assembly can be secured to the main beam.

According to another embodiment of this invention, the bow assembly can be located anywhere along the main beam within predetermined limits.

According to still another embodiment of this invention, a crossbow may have a handgrip which can be selectively located at least two locations on the main beam.

One advantage of this invention is that the draw weight of a crossbow can be easily changed.

Another advantage of this invention is that multiple draw weights can be provided in an inexpensive manner using a single crossbow.

Another advantage of this invention is that handgrip can be easily adjusted to suit the preference of the crossbow user.

Still other benefits and advantages of the invention will become apparent to those skilled in the art to which it pertains upon a reading and understanding of the following detailed specification.

III. BRIEF DESCRIPTION OF THE DRAWINGS

The invention may take physical form in certain parts and arrangement of parts embodiments of which will be described in detail in this specification and illustrated in the accompanying drawings which form a part hereof and wherein.

IV. DEFINITIONS

The following definitions are controlling for the disclosed invention:

"Arrow" means a projectile that is shot with (or launched by) a bow assembly.

"Bow" means a bent, curved, or arched object.

"Bow Assembly" means a weapon comprising a bow and a bowstring that shoots or propels arrows powered by the elasticity of the bow and the drawn bowstring.

"Bowstring" means a string or cable attached to a bow.

"Compound Bow" means a crossbow that has pulleys or cams at each end of the bow through which the bowstring passes.

"Crossbow" means a weapon comprising a bow assembly and a trigger mechanism both mounted to a main beam.

"Draw Weight" means the amount of force required to draw or pull the bowstring on a crossbow into a cocked condition.

"Main Beam" means the longitudinal structural member of a weapon used to support the trigger mechanism and often other components as well. For crossbows, the main beam also supports the bow assembly. The main beam often comprises a stock member, held by the person using the weapon, and a barrel, used to guide the projectile being shot or fired by the weapon.

"Trigger Mechanism" means the portion of a weapon that shoots, fires or releases the projectile of a weapon. As applied to crossbows, trigger mechanism means any device that holds the bowstring of a crossbow in the drawn or cocked condition and which can thereafter be operated to release the bowstring out of the drawn condition to shoot an arrow.

"Weapon" means any device used in fighting or hunting that shoots or fires a projectile including bow assemblies and crossbows.

IV. DETAILED DESCRIPTION OF THE INVENTION

Figure 1:
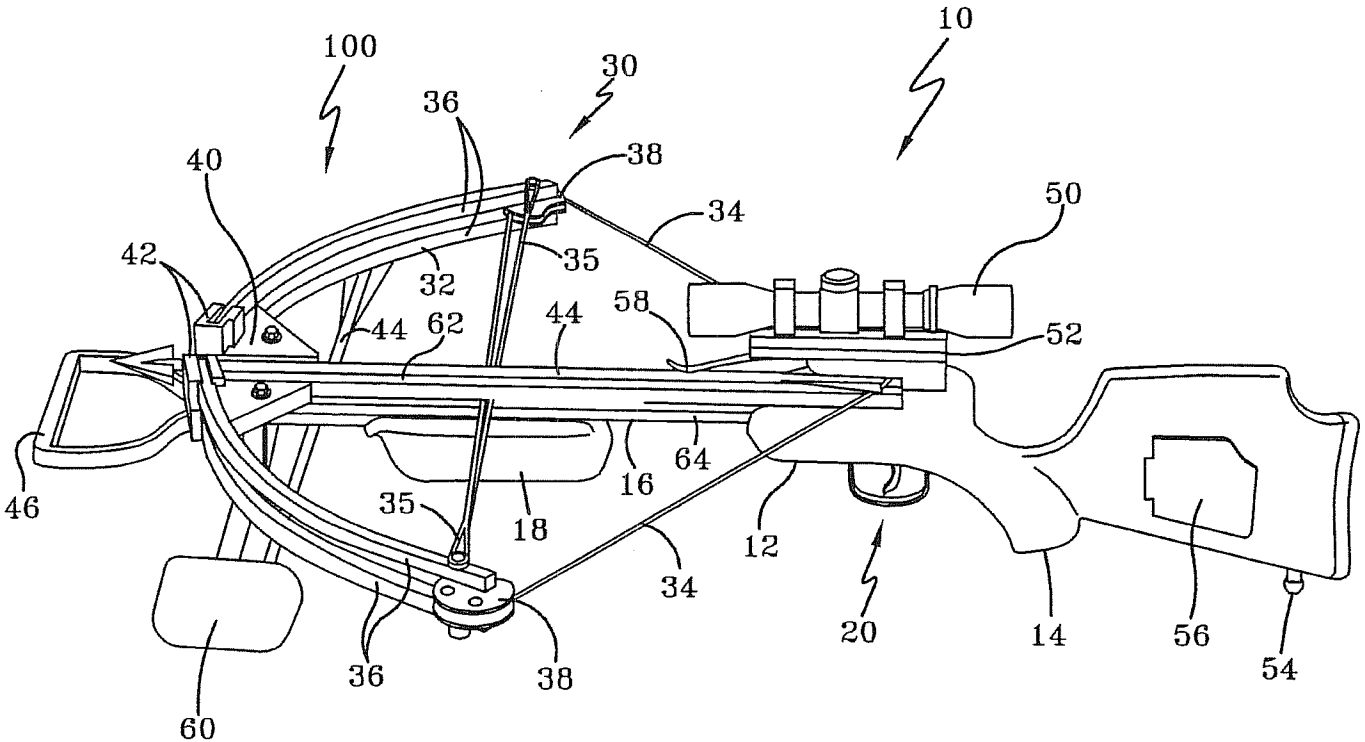
FIG. 1 is a perspective side view of a crossbow equipped with a mounting apparatus according to one embodiment of this invention.

Referring now to the drawings wherein the showings are for purposes of illustrating embodiments of the invention only and not for purposes of limiting the same, FIG. 1 shows a crossbow 10 equipped with the bow assembly mounting apparatus 100 of this invention. While the crossbow shown is a compound bow, it should be understood that this invention will work well with any type of crossbow chosen with sound engineering judgment. The crossbow 10 has a main beam 12 including a stock member 14 and a barrel member 16. The main beam 12 may be made by assembling the stock member 14 and the barrel member 16 together as separate components or, in another embodiment, the main beam 12 may be made as one piece. A handgrip 18 may be mounted to the main beam 12 in any conventional manner or in a manner to be described further below. A trigger mechanism 20 suitable for shooting an arrow is mounted to the main beam 12 in any suitable manner. It should be noted that this invention will work well with any trigger mechanism chosen with sound engineering judgment. The crossbow 10 also includes a bow assembly 30 adapted to propel an arrow and having a bow 32 and a bowstring 34. The bow 32 includes a pair of limbs 36, 36 that receive the bowstring 34 in any conventional manner. For the embodiment shown, a pair of wheels or pulleys 38, 38 mounted to the limbs 36, 36 receive the bowstring 34 in a known manner. The bow may also include a block 40 having a pair of limb pockets 42, 42 that receive the limbs 36, 36, as shown. An arrow 44 is shown supported on the barrel member 16 and the bowstring 34 is shown in the drawn or cocked position. The arrow 44 is thus in a ready-to-shoot position.

Figure 2:
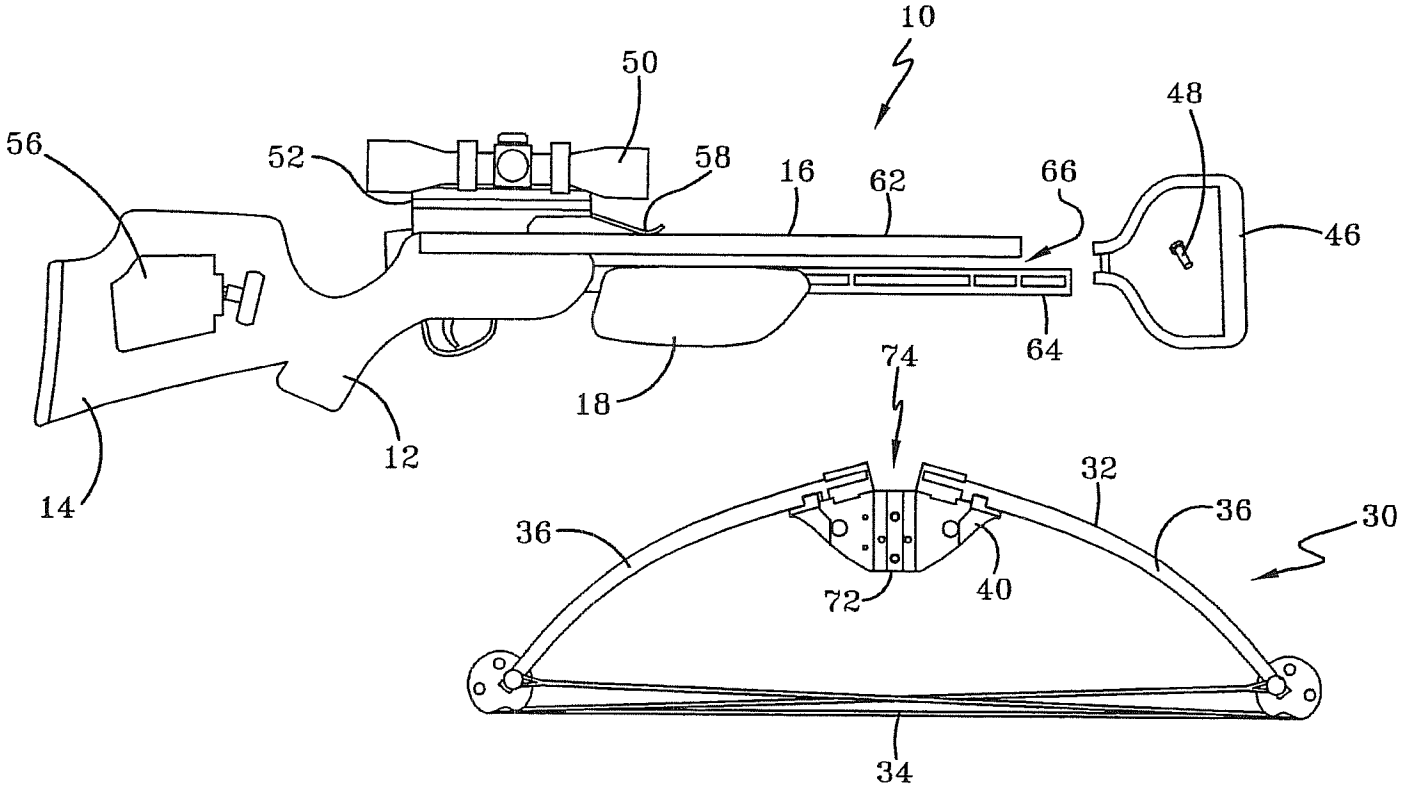
FIG. 2 is a plan view of the crossbow shown in FIG. 1 shown in a disassembled state.

With reference now to FIGS. 1 and 2, many other crossbow components may be optionally used with a crossbow using this invention. The crossbow 10 shown, for example, includes a foot stirrup 46 mounted to one end of the main beam 12 with a bolt 48, a scope 50 attached to a scope mount 52 that is supported on the main beam 12, and one or more swivel studs 54. Other optional components shown include a cocking unit 56, an arrow retention spring 58 and an arrow quiver 60. As the operation of these components is well known to those of skill in the art, no further details will be provided.

Figure 7:
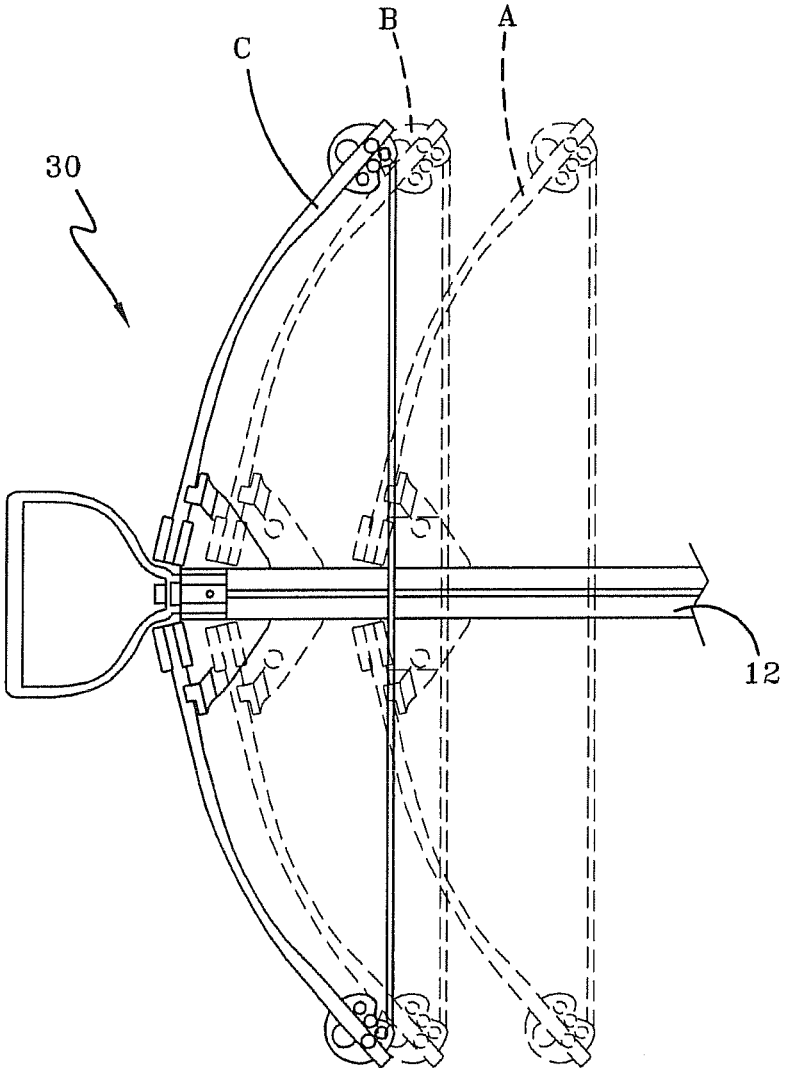
FIG. 7 is a top view of a portion of the crossbow shown in FIG. 1 illustrating the three locations on the main beam that the bow assembly may be mounted.

With reference now to FIGS. 1-2 and 7, the bow assembly mounting apparatus 100 of this invention permits the bow assembly 30 to be mounted to the main beam 12 at multiple locations on the main beam 12. Each distinct location changes the distance between the bow assembly 30 and the trigger mechanism 20 and thereby changes the distance the bowstring 34 must be drawn to place it in the cocked position. As understood by those of skill in the art, this change in drawing distance changes the effective draw weight of the crossbow 10. FIG. 7 shows the bow assembly 30 mounted at three locations referenced A, B and C.

With reference now to FIGS. 1-10, the barrel member 16 segment of the main beam 12 has first and second portions 62, 64 separated by a groove 66. As seen best in FIGS. 1, 2 and 8, in the embodiment shown, the first portion 62 is a top portion of the barrel member 16 and the second portion 64 is a bottom portion. However, this embodiment of this invention would work with other portion arrangements such as positioning the first portion 62 on one side of the main beam 12 and the second portion 64 on the opposite side thus forming a right side barrel portion and a left side barrel portion. The two barrel portions 62, 64 may be made as separate components and then assembled together or the two barrel portions 62, 64 may be made as one piece. As seen best in FIGS. 2-6 and 9, the block 40 may have a bridge 72 that is received within the groove 66 formed in the barrel member 16. The block 40 and thus the bow assembly 30 can be moved along the axis of the main beam 12 within the groove 66 and then mounted to the main beam 12 as will be described further below. Note that the cable elements 35 used to engage the pulleys 38, 38 may also be received within the groove 66. In one embodiment, the block 40 has a channel 74 that receives one of the main beam portions 62 or 64. This forms a tongue in groove type connection (where the main beam portion 62 or 64 is the "tongue" and the channel 74 is the "groove") to maintain the bow assembly 30 in proper alignment with the main beam 12 and with the trigger mechanism 20. For the embodiment shown the channel 74 receives the first portion 62 of the main beam 12 but it also contemplated to form the channel 74 to receive the second portion 64.

With reference now to FIGS. 3-7 and 10-15, the block 40 may have at least one opening 41, two shown and the main beam 12 may also have one opening, two shown for each location where the bow assembly 30 can be mounted. To mount the bow assembly 30 to the main beam 12 at location A, for example, the block 40 is moved until the block openings 41, 41 are aligned with the main beam openings A1, A2 at location A. At least one connection member, two shown 76, 76, such as a bolt, can then be inserted through the main beam openings A1, A2 and into the block openings 41, 41. In one embodiment, the connection members 76, 76 may have threads that engage threads formed in the block openings 41, 41 so that the block 40 can be secured to the main beam 12. It should be noted that in the embodiment just described the beam openings A1, A2 are formed in the lower portion 64 of the barrel member 16 and thus the connection members 76, 76, secure the block 40 to the lower portion 64 of the barrel member 16. In another embodiment, the block 40 may be secured to the upper portion 62 of the barrel member 16. In yet another embodiment, shown, the block 40 may be secured to both the upper and lower portions 62, 64 of the barrel member 16. To secure the block 40 to the upper portion 62 of the barrel member 16, the block 40 may have at least one opening 43, two shown 43, 43, and the upper portion 62 of the barrel member 16 may have at least one corresponding opening A3, two shown A3, A4. Connection members 78, 78 (one connection member 78 shown but two used in this embodiment) can be inserted through the openings 43, 43 formed in the block 40 and into the openings A3, A4 formed in the upper portion 62 of the barrel member 16. In one embodiment, the connection members 78, 78 may have threads that engage threads formed in the openings A3, A4.

Figure 6:
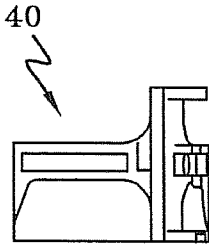
FIG. 6 is a side view of the block shown in FIG. 4.
Figure 3:
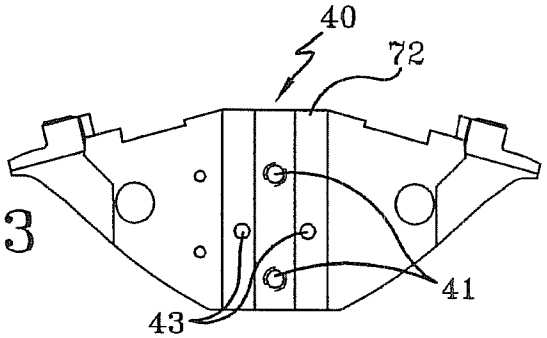
FIG. 3 is a top view of one embodiment block shown detached from the crossbow.
Figure 4:
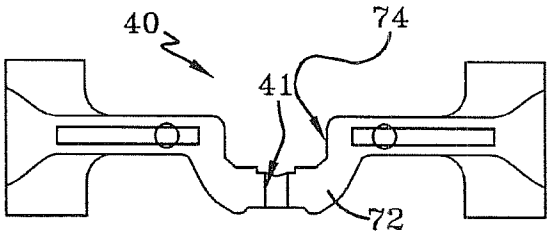
FIG. 4 is an end view of the block shown in FIG. 3.
Figure 5:
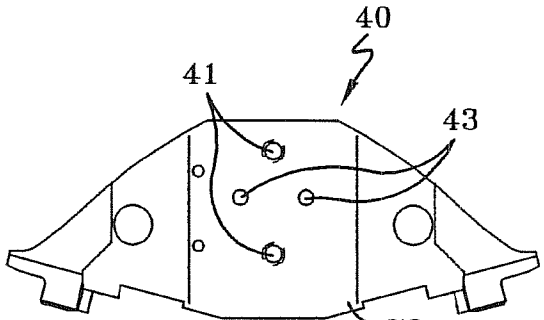
FIG. 5 is a bottom view of the block shown in FIG. 3.
Figure 8:
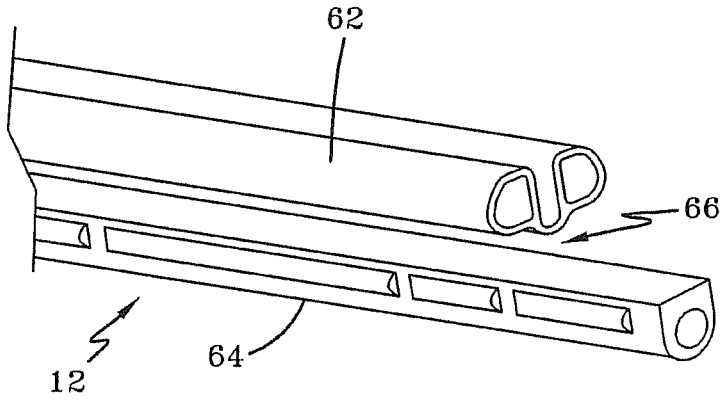
FIG. 8 is a close-up view of the end of the main beam showing the first and second portions separated by a groove that may make up the barreled member.
Figure 9:
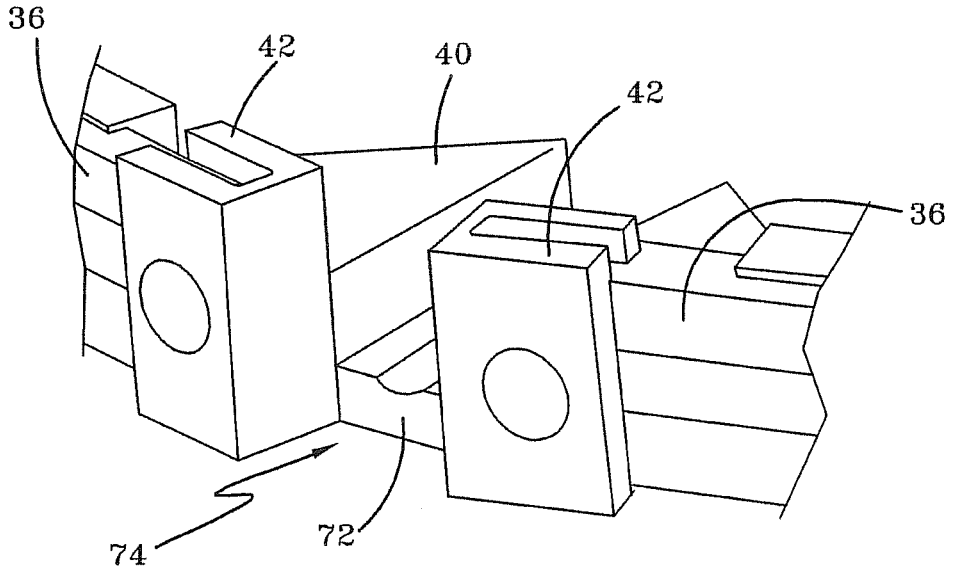
FIG. 9 is a close-up view of the block.
Figure 10:
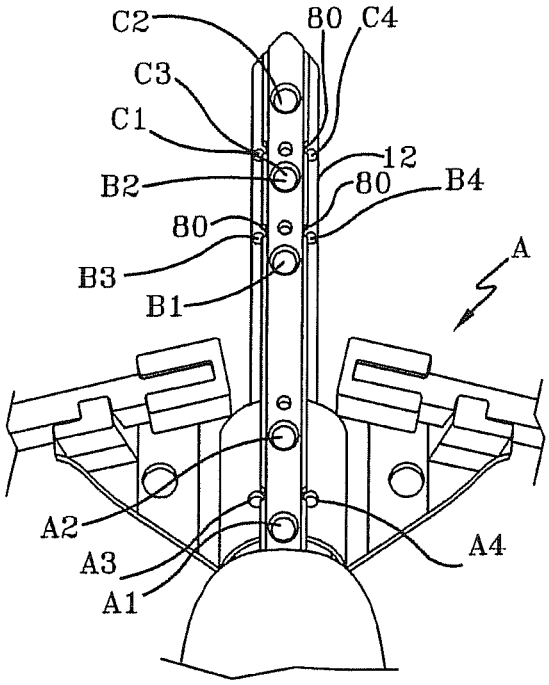
FIG. 10 is a close up view of a portion of the crossbow showing the bow assembly mounted at location A.
Figure 11:
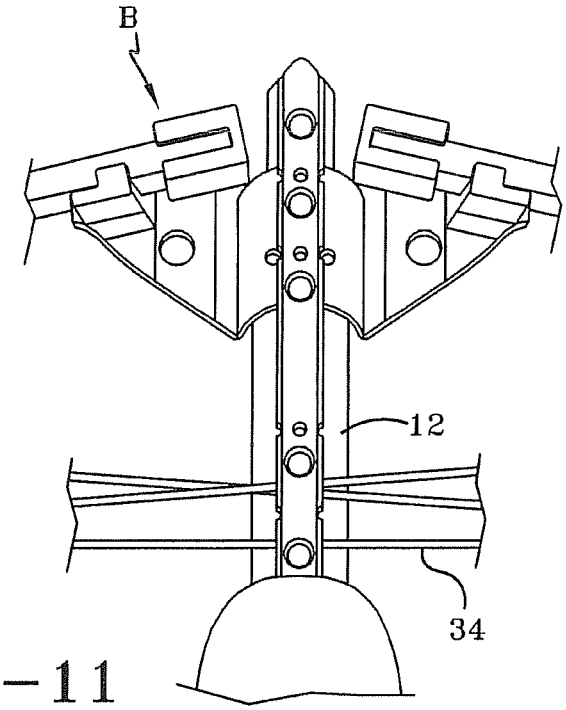
FIG. 11 is a view similar to that shown in FIG. 10, but showing the bow assembly mounted at location B.
Figure 12:
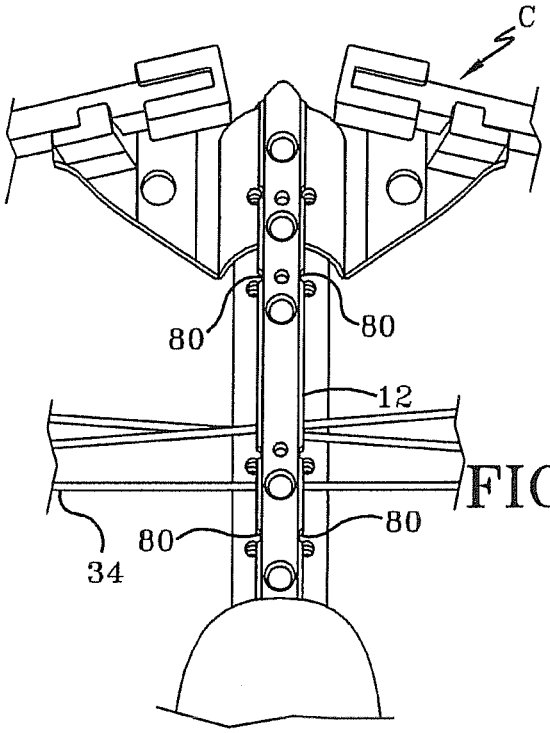
FIG. 12 is a view similar to that shown in FIG. 10, but showing the bow assembly mounted at location C.
Figure 13:
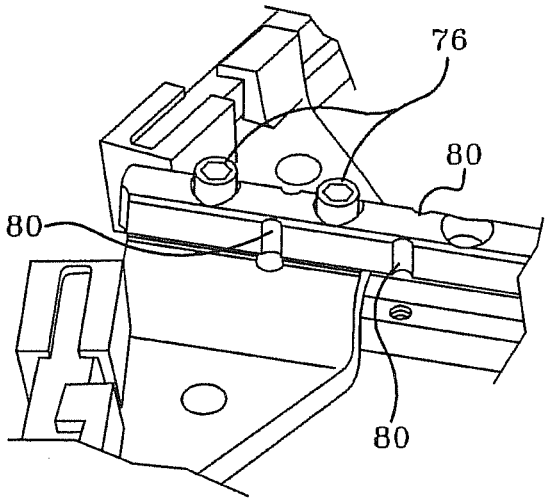
FIG. 13 is a close-up perspective view showing how the block may be mounted to the main beam.
Figure 14:
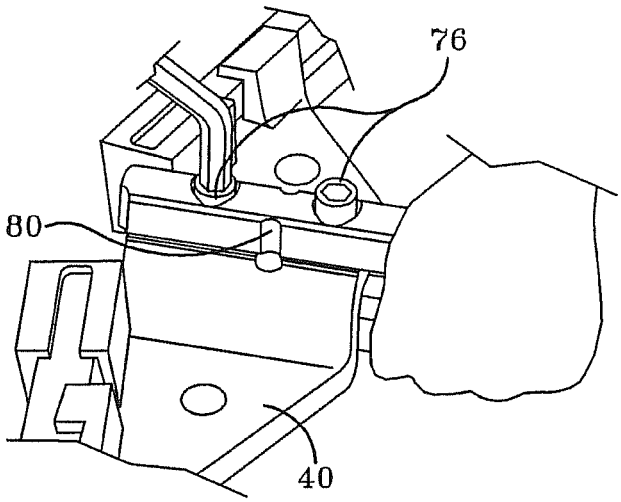
FIG. 14 is a view similar to that shown in FIG. 13, but illustrating how a user may secure the block to the main beam.
Figure 15:
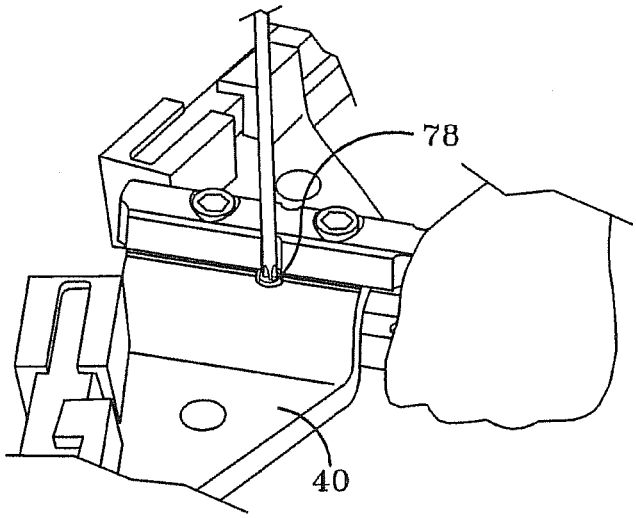
FIG. 15 is a view similar to that shown in FIG. 13, but illustrating more detail of how the block may be secured to the main beam.
Figure 16:
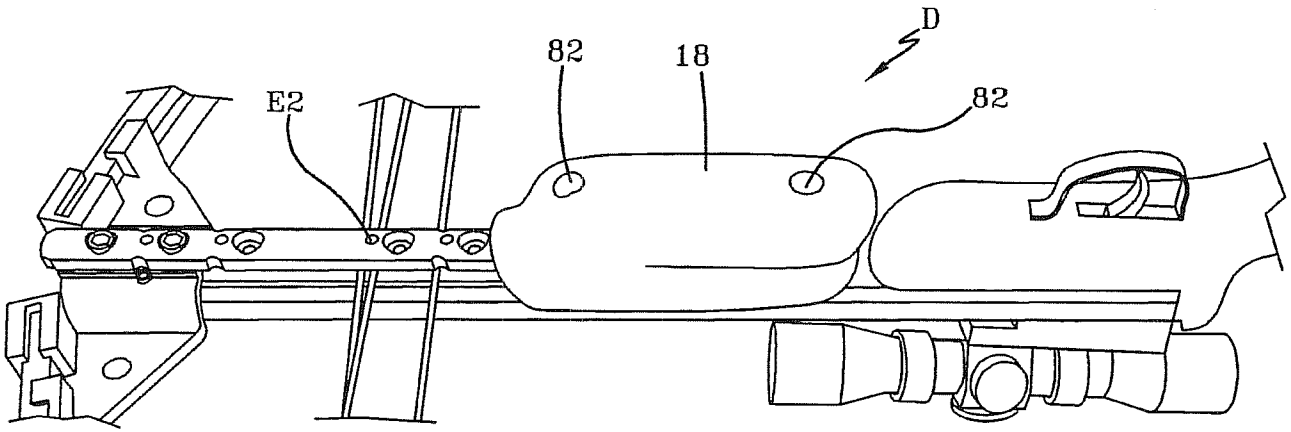
FIG. 16 is a perspective bottom view showing the handgrip mounted at a first location on the main beam.
Figure 17:
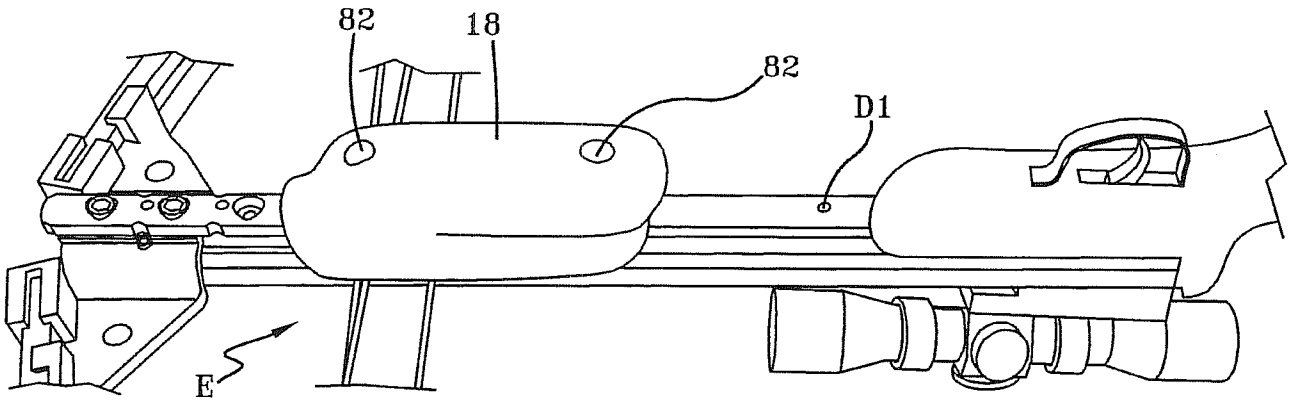
FIG. 17 is a view similar to that shown in FIG. 16, but showing the handgrip mounted at a second location on the main beam.

With continuing reference to FIGS. 3-7 and 10-15, to mount the bow assembly 30 to the main beam 12 at location B, for example, the block 40 is moved until the block openings 41, 41 are aligned with the openings B1, B2 in the lower portion 64 of the barrel member 16 at location B and the block openings 43, 43 are aligned with the openings B3, B4 in the upper portion 62 of the barrel member 16 at location B. Connection members 76, 76 can then be inserted through the openings B1, B2 and into the block openings 41, 41 and the connection members 78, 78 can be inserted through the block openings 43, 43 and into the openings B3, B4. Similarly, to mount the bow assembly 30 to the main beam 12 at location C the block 40 is moved until the block openings 41, 41 are aligned with the openings C1, C2 in the lower portion 64 of the barrel member 16 at location C and the block openings 43, 43 are aligned with the openings C3, C4 in the upper portion 62 of the barrel member 16 at location C. The connection members 76, 76 can then be inserted through the openings C1, C2 and into the block openings 41, 41 and the connection members 78, 78 can be inserted through the block openings 43, 43 and into the openings C3, C4. With this arrangement, one set of one or more connection members can be used to secure the block 40 to any of the locations A, B and C on the main beam 12. It should be noted that in one embodiment each of the main beam openings A1, A2, A3, A4, B1, B2, B3, B4, C1, C2, C3, C4 are single location openings. By "single location" it is meant that the opening only serves to hold the bow assembly 30 to one location. With this embodiment, for example, openings B2 and C1 are separate openings with opening B2 used only to hold the bow assembly 30 to location B and opening C1 used only to hold the bow assembly 30 to location C. In another embodiment, show, at least one of the main beam openings A1, A2, A3, A4, B1, B2, B3, B4, C1, C2, C3, C4 are multiple location openings. By "multiple location" it is meant that the opening may serves to hold the bow assembly 30 at more than one location. With this embodiment, as shown in FIG. 6, references B2 and C1 are referring to the same opening. This opening serves to hold the bow assembly 30 at location B, as shown in FIG. 7, and at location C, as shown in FIG. 8. Of course some of the openings may be single location while others are multiple location.

With continuing reference to FIGS. 3-7 and 10-15, for the embodiment shown, the block mounting locations A, B and C are predetermined. By "predetermined" it is meant that the block mounting locations are established by the crossbow manufacturer. This enables the crossbow manufacturer to choose the locations in accordance with specifically desired draw weights. As a non-limiting example: (a) when the bow assembly 30 is mounted to the main beam 12 at location A, the crossbow 10 may provide a draw weight of 125 LBS and a corresponding arrow speed of 220 FPS; (b) when the bow assembly 30 is mounted to the main beam 12 at location B, the crossbow 10 may provide a draw weight of 150 LBS and a corresponding arrow speed of 280 FPS; and, (c) when the bow assembly 30 is mounted to the main beam 12 at location C, the crossbow 10 may provide a draw weight of 175 LBS and a corresponding arrow speed of 305 FPS. It is to be understood that the use of three block mounting locations is exemplary only as the number and specific locations of the mounting locations can be any chosen with sound engineering judgment.

With reference now to FIGS. 1, 3-7 and 10-15, to change the draw weight of the crossbow 10, it is only necessary to move the bow assembly 30 from one location, location A for example, to another location, location B for example. This can easily be done, in one embodiment, by removing the connection members 76, 78 that hold the bow assembly 30 in one location, moving the bow assembly 30 along the main beam 12 to another location, and securing the bow assembly 30 to the new location with the same connection members 76, 78. In one embodiment, alignment markings 80 may be used to assist the user in properly aligning the bow assembly 30 with the main beam 12. While the particular alignment markings 80 may be of any type chosen with sound engineering judgment including color marks, decals, surface markings and the like. For the embodiment shown, the alignment markings 80 are notches formed in the surface of the barrel member 16.

With reference now to FIGS. 10-15, it should be noted that while the embodiments described above include the use of a threaded connector 76, 78 to secure the block 40 to the barrel member 16 the inventors contemplate numerous other methods. Some non-limiting examples include the use of spring loaded pins, thumb screws, and cam locking collets. In another embodiment, the block 40 can be mounted at any location chosen by the user, within the limits of the groove 66. One or both of the barrel portions 62, 64 may have a slot along their length, for example, that receives a cam locking mechanism.

With reference now to FIGS. 1-2 and 16-17, in another embodiment the handgrip 18 may be mounted to the main beam 12 at multiple locations. This enables the user to adjust the position of the handgrip 18 according to the user's comfort. The handgrip 18 may have at least one opening, two shown 82, 82 and the main beam 12 may also have at least one opening, two used, at each location. To mount the handgrip 18 to the main beam 12 at location D (shown in FIG. 16), the handgrip is moved until the handgrip openings 82, 82 are aligned with the main beam openings D1 and another similar opening not visible. At least one connection member, two shown used, such as a bolt, can then be inserted through the handgrip openings 82, 82 and into the main beam openings. The connection members may have threads that engage threads formed in the main beam openings so that the handgrip 18 can be secured to the main beam 12. To mount the handgrip 18 to the main beam 12 at location E (shown in FIG. 17), the connection members are removed from the handgrip 18. The handgrip 18 is then moved until the handgrip openings 82, 82 are aligned with the main beam openings E2 and another similar opening not visible. The connection members can then be inserted through the handgrip openings 82, 82 and into the main beam openings. Note that the main beam openings may be single location or multiple location openings as described above.

Multiple embodiments have been described, hereinabove. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

Having thus described the invention, it is now claimed:

1. A crossbow comprising:

a main beam comprising a barrel having a length; and a bow assembly mounted upon said main beam, comprising:

a pair of bow limbs and a bowstring operatively connected to the bow limbs;

wherein the bow assembly is selectively movable along the length of the barrel to provide differing draw weights.

2. The crossbow of claim 1, wherein the bow assembly further comprises:

a block operably connected to the barrel, wherein the pair of bow limbs are operatively connected to the block and the block can be selectively removed from the barrel.

3. The crossbow of claim 2, wherein the block further comprises:

a connection member for selectively removing the block from the barrel.

* * * * *